US010007227B2

(12) United States Patent
Keniston et al.

(10) Patent No.: US 10,007,227 B2
(45) Date of Patent: Jun. 26, 2018

(54) DOOR SEQUENCING DEVICE FOR AN IMAGING DEVICE THAT CONTROLS WHETHER A CLEANING PROCESS IS EXECUTED, DEPENDING ON AN ELAPSED TIME

(71) Applicant: LEXMARK INTERNATIONAL, INC., Lexington, KY (US)

(72) Inventors: Matthew Ryan Keniston, Lexington, KY (US); Jimmy Zamora Lucas, Cebu (PH)

(73) Assignee: Lexmark International, Inc., Lexington, KY (US)

( * ) Notice: Subject to any disclaimer, the term of this patent is extended or adjusted under 35 U.S.C. 154(b) by 0 days. days.

(21) Appl. No.: 15/220,724

(22) Filed: Jul. 27, 2016

(65) Prior Publication Data

US 2018/0032026 A1 Feb. 1, 2018

(51) Int. Cl.
*G03G 21/00* (2006.01)
*G03G 21/16* (2006.01)

(52) U.S. Cl.
CPC ..... *G03G 21/1633* (2013.01)

(58) Field of Classification Search
CPC ..... G03G 21/1633
USPC ..... 399/110
See application file for complete search history.

(56) References Cited

U.S. PATENT DOCUMENTS

2007/0116506 A1* 5/2007 Portig ..... B41J 29/02 400/691
2012/0237254 A1* 9/2012 Fukuda ..... G03G 15/0194 399/114

* cited by examiner

*Primary Examiner* — Quana M Grainger

(57) ABSTRACT

An imaging device having a door closing sequencing device to ensure a proper closing sequence of two mating doors. The sequencing device includes a door stop, a link, and a hinge. The hinge and door stop are pivotally connected to a side panel of a frame. The hinge, link, and door stop are pivotally connected together. The hinge is affixed to a first of the mating doors, and, when the first of the mating doors is in an open position, the hinge and link rotate the door stop into an extended position preventing a second of the mating doors from closing until the first of the mating doors is returned to its closed position moving the door stop into a retracted position.

18 Claims, 14 Drawing Sheets

DOOR SEQUENCING DEVICE FOR AN IMAGING DEVICE THAT CONTROLS WHETHER A CLEANING PROCESS IS EXECUTED, DEPENDING ON AN ELAPSED TIME

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

Field of the Invention

The field relates generally to an imaging device and, in particular, a device for controlling the closing sequence of doors provided on the housing.

Description of the Related Art

In imaging devices, doors are provided to allow users to access interior portions of the imaging device to replace components such as exhausted toner cartridges, and to access the media path to remove media jams. In some cases adjacent doors need to be closed in a given sequence, and, if the closing sequence is not done properly, the doors may not latch or may be out of position. Further, one of the doors may have a component, such as user interface or media guides, that need to be oriented in a certain way when the door is properly closed and may not, should the closing sequence be done out of order.

A "front-is-front" c-shaped media path imaging device, the primary (simplex) and secondary (duplex) paper paths reside just inside the front access door or cover of the imaging device. The media path from the media input tray through the imaging area to the output area of the imaging device is generally in the form of a C with the media input being at the lower end of the C and the output area being at the upper end. The simplex and duplex paths form the body of the C connecting the upper and lower ends. The user can access portions of the machine, for purposes of error intervention and/or component replacement, by opening the front access door or cover. In this architecture, the front access door typically rotates about pivot points at the bottom, such that the door opens toward the user and downward. Opening the door in this manner typically give access to the primary paper path. The duplex path can be accessed on the inside of the front access door either directly, or after actuation of some secondary inner door. To accommodate a C-type architecture, a break point in the paper path is provided at the top of the front access door. Depending on the customer interface requirements, a second customer-accessible door is provided and positioned above the front access door in a type of clam shell arrangement. A top access door provides access to the upper portion of the media path and the exit of the fuser in the imaging section. However this top access door is less frequently used, and it may also house a user interface. Also because the top access door is rotated up away from the housing, either the user needs to hold the top access door open or supports for holding the top access door open are needed.

To support the "front-is-front" C-path imaging device, the media path guide ribs must be designed in such a way as to ensure the hand off of media from the outer duplex ribs on the underside of the top access door to the outer duplex guide ribs on the inside of the front access door without defects that could cause paper feed failures. It is common to intermesh cantilevered ribs to minimize or eliminate completely the gap defined by the break between the two sections of media path caused by the need to have the front and top access doors. This process typically requires that the doors be closed in a specific order to prevent damage to the cantilevered portions of the media guide ribs that may result in media feed failures. With these types of imaging devices, the less frequently accessed door is meant to be closed prior to closing the more frequently accessed door. The front access door in a "front-is-front" architecture is more frequently actuated for interventions, as well as gaining access to replaceable maintenance items like the fuser and the image transfer unit.

Prior imaging devices focused on preventing one door from closing if the other was closed out of sequence. This forced the user to undo an action previously completed (close one door), perform another action (close second access door), then redo the first action (close first access door again). In addition, the user needed to realize that the first successfully performed action must be undone to complete the entire process. If the user failed to understand that backing up and restarting the closing process was necessary and forced the second access door to close, damage to the doors or the imaging device may have occurred.

It would be beneficial to have a sequencing device that can prevent the successful completion of any portion of the door closing operation out of the correct sequence. It would be of further benefit if the sequencing device may also be able to hold the top access door in an open position without user intervention.

SUMMARY OF THE INVENTION

Disclosed is an imaging device having a door closing sequencing device to ensure a proper closing sequencing of two mating access doors. The imaging device comprises a frame having a pair of opposed panels spaced apart and having a media path therebetween, a first access door, a second access door mateable with the first access door, and a door sequencing device.

The first access door is pivotally mounted along a bottom edge thereof to the frame and has a raised closed position and a lowered open position with respect to the frame. The first access door substantially covers a first portion of the media path between the pair of opposed panels when in the closed position. The first access door has a mating edge and an inner surface having a first plurality of media guide ribs. The second access door is pivotally mounted along a top edge of the frame and has a raised open position and a lowered closed position with respect to the frame. The second access door substantially covers a second portion of the media path between the pair of opposed panels when in the closed position. The second access door has a mating edge aligned with the mating edge of the first access door when the first and second access doors are in their respective closed positions. An inner surface of the second access door has a second plurality of media guide ribs and at least one of the first and second pluralities of media guide ribs has a cantilevered section extending beyond the respective mating edge.

The door sequencing device is attached between the frame and the second access door and includes a door stop, a hinge, and a link. The door stop is connected to one of the opposed panels and pivotable between a retracted position and an extended position. The hinge is pivotally connected at a first end to the one of the opposed panels and attached to the second access door at a second end. A detent finger extends from the hinge. The link has a first end pivotally connected to the door stop and a second end pivotally connected to the hinge adjacent to the detent finger. The second end of the link has a first detent and a second detent sized to receive an end of the detent finger with the second detent spaced apart from the first detent.

When the second access door is in the closed position and the first access door is in the open position, the detent finger is in the first detent and the door stop is in the retracted position allowing the first access door to be moved into a closed position. When the second access door and the first access door are in their respective open positions, the detent finger is in the second detent holding the second access door in its open position. The door stop has rotated out into its extended position preventing the first access door from reaching its closed position until the second access door is moved into its closed position. Closing the second access door rotates the door stop back into its retracted position with the detent finger returning to the first detent and allowing the first access door to be fully closed.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings.

FIG. 4 shows the access doors in their closed positions and FIG. 5 shows the access door in their open positions.

FIG. 12 shows the closed or retracted position and FIG. 13 shows the extended position.

DETAILED DESCRIPTION

Figure 1:
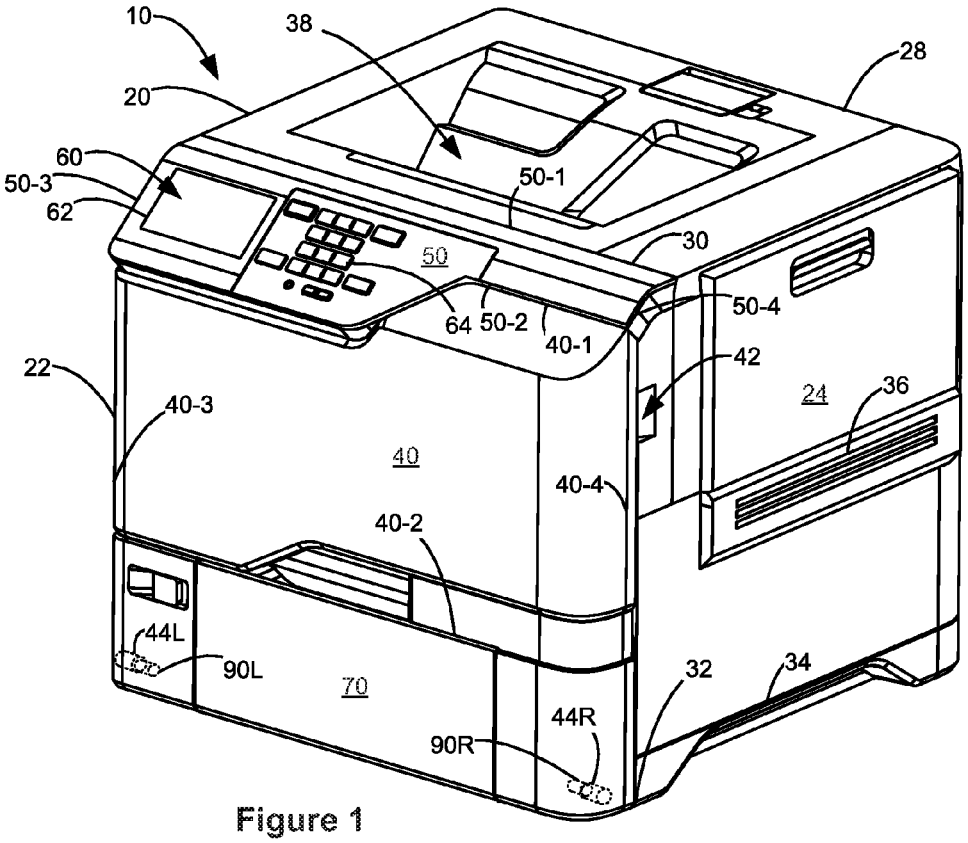
FIGS. 1-2 are perspective views of an imaging device having a door sequencing device of the present disclosure.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise. The use of "including", "comprising", or "having" and variations thereof herein is meant to encompass the items listed thereafter and equivalents thereof as well as additional items.

Terms such as "about" and the like have a contextual meaning, are used to describe various characteristics of an object, and have their ordinary and customary meaning to persons of ordinary skill in the pertinent art. Terms such as "about" and the like, in a first context mean "approximately" to an extent as understood by persons of ordinary skill in the pertinent art; and, in a second context, are used to describe various characteristics of an object, and in such second context mean "within a small percentage of" as understood by persons of ordinary skill in the pertinent art.

Unless limited otherwise, the terms "connected", "coupled", and "mounted", and variations thereof herein are used broadly and encompass direct and indirect connections, couplings, and mountings. In addition, the terms "connected" and "coupled" and variations thereof are not restricted to physical or mechanical connections or couplings. Spatially relative terms such as "left", "right", "top", "bottom", "front", "back", "rear", "side", "under", "below", "lower", "over", "upper", and the like, are used for ease of description to explain the positioning of one element relative to a second element. These terms are intended to encompass different orientations of the device in addition to different orientations than those depicted in the figures. Relative positional terms may be used herein. For example, "superior" means that an element is above another element. Conversely "inferior" means that an element is below or beneath another element. Further, terms such as "first", "second", and the like, are also used to describe various elements, regions, sections, etc. and are also not intended to be limiting. Where possible, like terms refer to like elements throughout the description. A plurality of different structural components may be utilized to implement the media restraint of the present disclosure. Furthermore, and as described in subsequent paragraphs, the specific mechanical configurations illustrated in the drawings are intended to be example embodiments of the present disclosure and that other alternative mechanical configurations are possible.

"Media" or "media sheet" refers to a material that receives a printed image or, with a document to be scanned, a material containing a printed image. The media is said to move along a media path, a media branch, and a media path extension from an upstream location to a downstream location as it moves from the media trays to the output area of the imaging system. For a top feed option tray, the top of the option tray is downstream from the bottom of the option tray. Conversely, for a bottom feed option tray, the top of the option tray is upstream from the bottom of the option tray. As used herein, the leading edge of the media is that edge which first enters the media path and the trailing edge of the media is that edge that last enters the media path. Depending on the orientation of the media in a media tray, the leading/trailing edges may be the short edge of the media or the long edge of the media, in that most media is rectangular. As used herein, the term "media width" refers to the dimension of the media that is transverse to the direction of the media path. The term "media length" refers to the dimension of the media that is aligned to the direction of the media path. "Media process direction" describes the movement of media within the imaging system, and is generally means from an input toward an output of the imaging device. The terms "front" "rear" "left" and "right" as used herein for the removable media tray and its components are with reference to the removable media tray being inserted in the imaging device or option assembly as viewed in FIG. 1.

As used herein, the term "communication link" is used to generally refer to structure that facilitates electronic communication between multiple components, and may operate using wired or wireless technology. Communications among components may be done via a standard communication protocol, such as for example, universal serial bus (USB), Ethernet or IEEE 802.xx.

Figure 2:
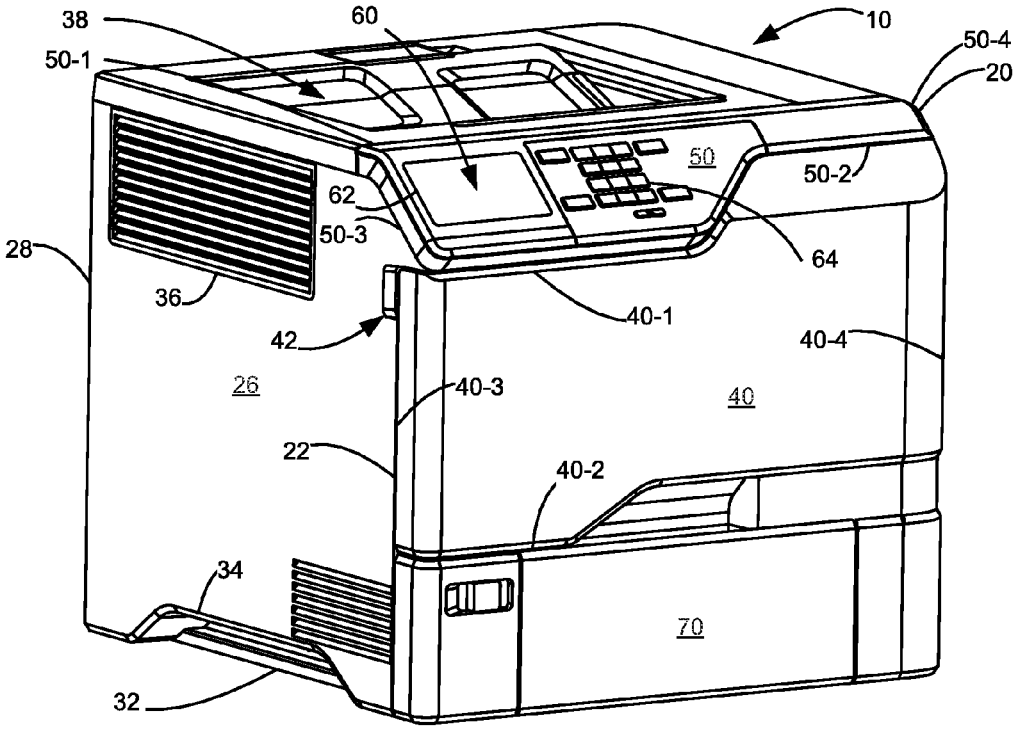
Figure 3:
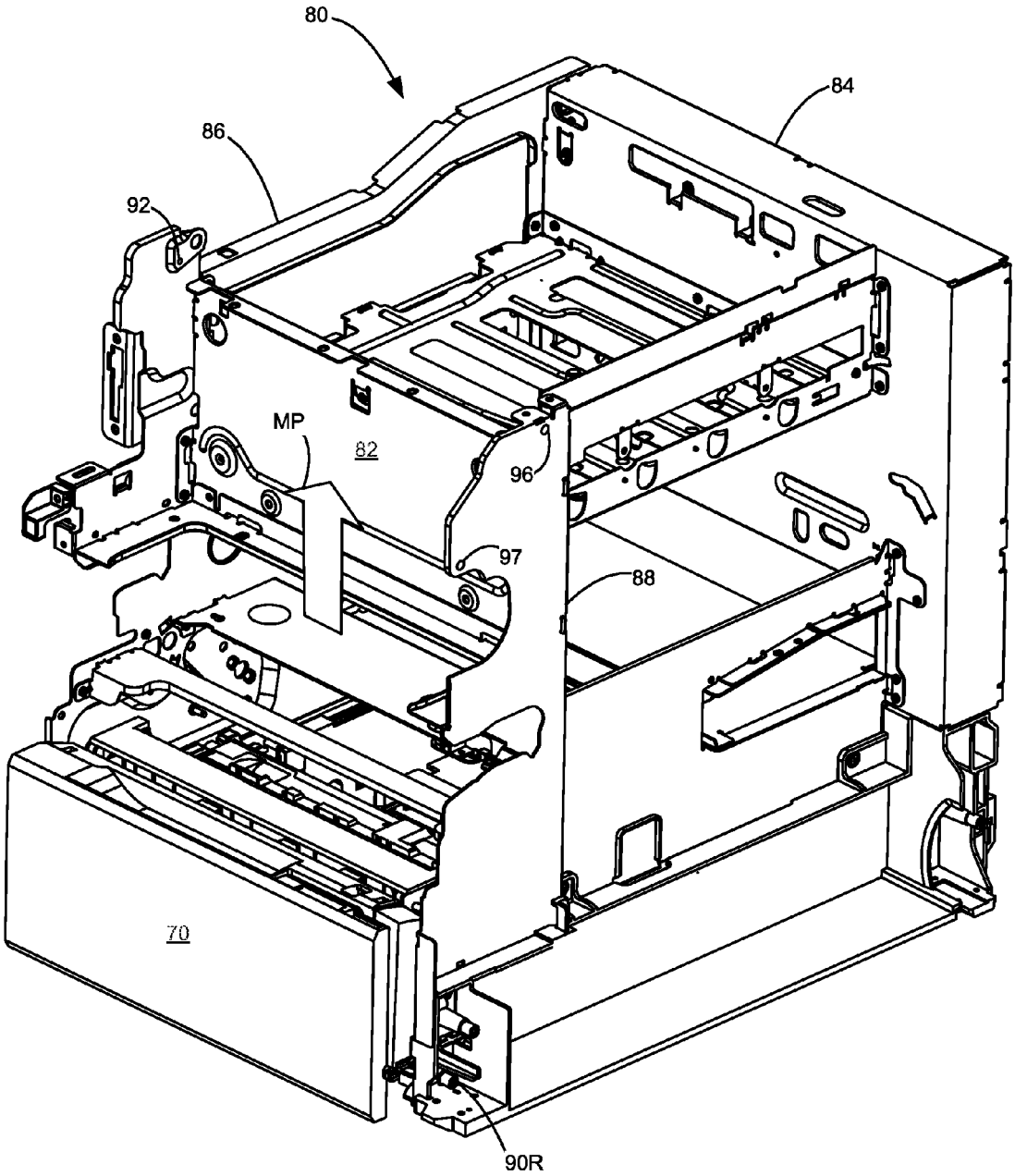
FIG. 3 is a perspective view of the frame of the imaging device of FIG. 1.
Figure 7:
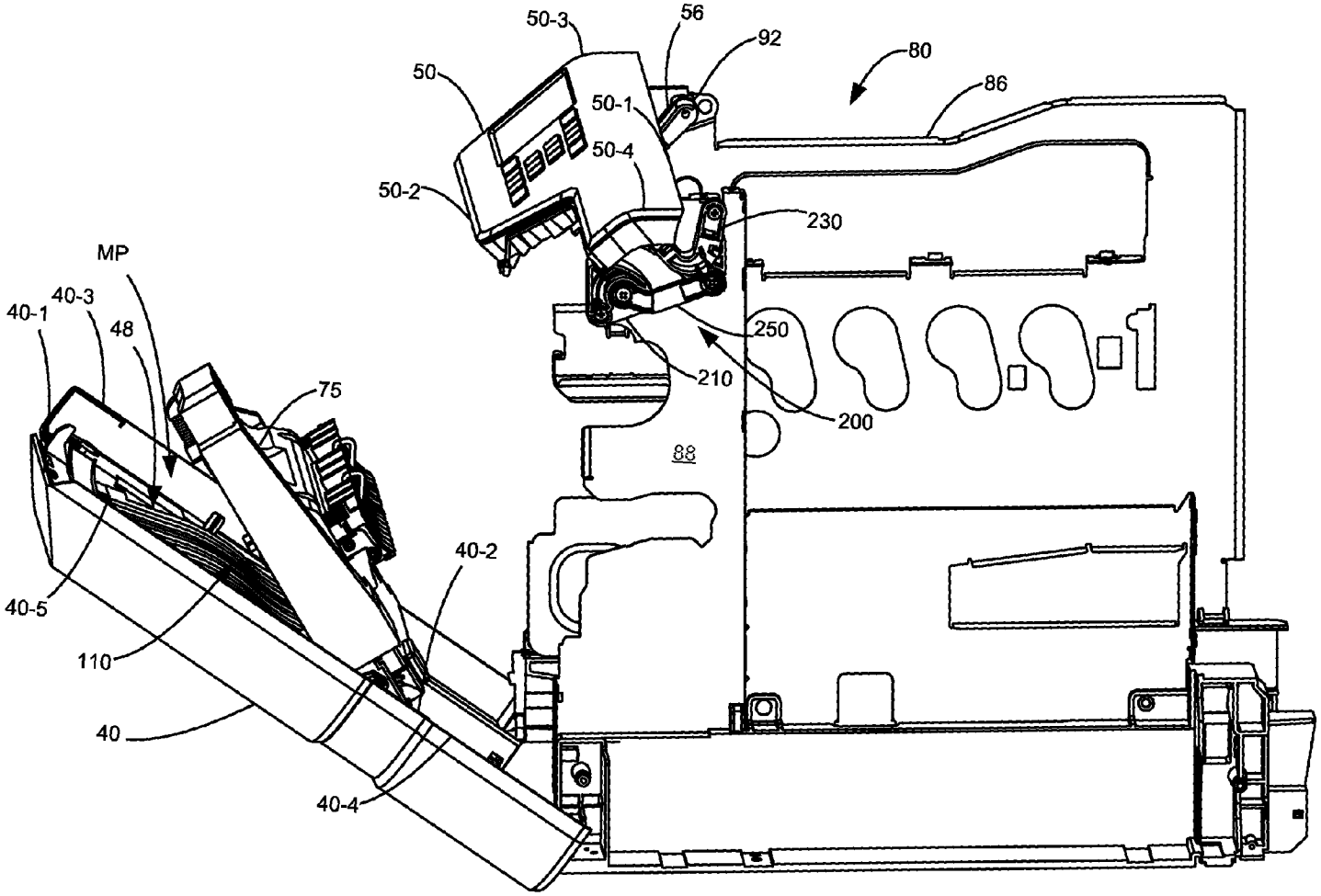
FIG. 7 is a right side elevational view showing the front access door in its open position and top access door in its closed position with the sequencing device of the present disclosure shown in its retracted position.
Figure 8:
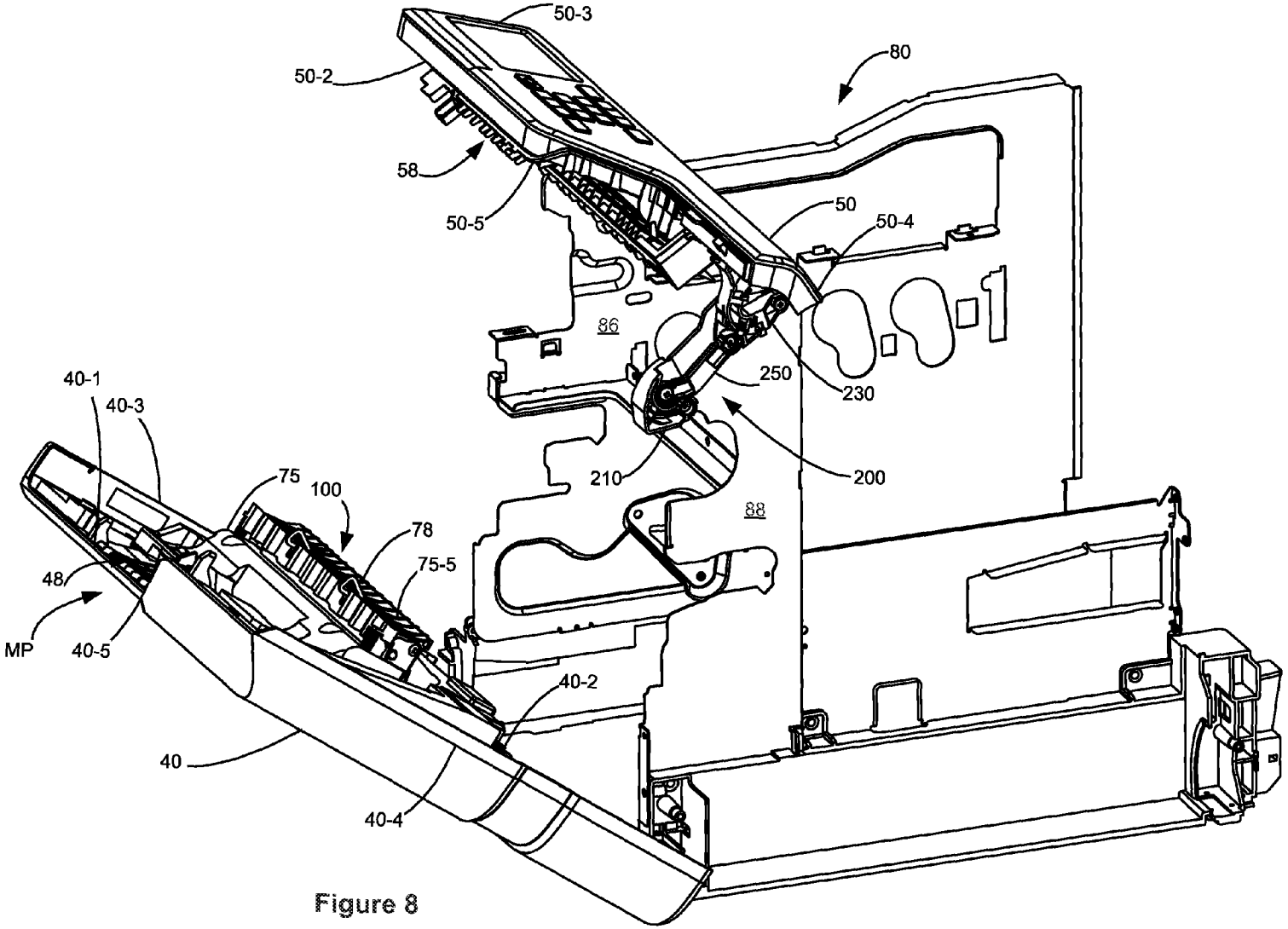
FIG. 8 is a right side elevational view showing the front access door in its open position and top access door in its open position with the sequencing device of the present disclosure shown in its extended position.

FIGS. 1-3 illustrate an example imaging device 10 having a housing 20 having a front 22, a first and second sides 24, 26, a rear 28, a top 30 and a bottom 32. Hand grips 34 are provided in several locations on housing 20 such as on sides 24, 26. Also, ventilation openings, such as vents 36 are provided on imaging device 10. A media output area 38 is provided on top 30 for printed media exiting imaging device 10. A front access door 40 and top access door 50 are provided on the front 22 of imaging device 10. Front access door 40 has a top edge 40-1, a bottom edge 40-2, a left edge 40-3, and a right edge 40-4. Door releases 42 are provided near top edge 40-1 at each side edge 40-3, 40-4 of door 40 and are used to open front access door 40 to allow user access into the interior of imaging device 10 for clearing media jam from the media path within imaging device 10 or to replace exhausted components. As shown in FIG. 1, front access door 40 is pivotally mounted to a frame 80 of imaging device 10 on left and right pivot posts 44L, 44R provided adjacent to its bottom edge 40-2. In FIGS. 1-2, front access door 40 is shown in a raised closed position. FIG. 7 shows front access door 40 in an opened lowered position. Top access door 50 is pivotally mounted to the frame 80. Top access door 50 has a top edge 50-1, a bottom edge 50-2, a left edge 50-3, and a right edge 50-4. Top access door 50 has a lower closed position as shown in FIGS. 1-2 and a raised opened position as shown in FIG. 8. Bottom edge 50-2 of top access door 50 and top edge 40-1 front access door 40 are mating edges when the two doors are in their respective closed positions. A user interface 60 including a display 62 and a key panel 64 are mounted on top access door 50. A removable media tray 70 for providing media to be printed is slidably inserted into imaging device 10 through an opening provided in front access door 40.

FIG. 3 illustrates the frame 80 having a front 82, rear 84, left side panel 86, and right side panel 88 joined together to define an interior volume. Frame 80 is used to support various internal components and housing 20 and front and top access doors 40, 50. Left and right side panels 86, 88 are positioned about the media path MP indicated by the arrow MP. As shown in FIG. 1, pivot posts 90L, 90R are provided on left and right side panels 86, 88 and engage with pivot posts 44L 44R of front access door 40. Only pivot post 90R is visible in FIG. 3. A pivot mount 92 is provided on the top edge of left side panel 86 and is connected to a hinge arm 56 (see FIG. 7) provided on the left side 50-3 of top access door 50. The right side 50-4 of top access door 50 is pivotally mounted to right side panel 88 via the sequencing device of the present disclosure. Mounting openings 96, 97 are provided in right side panel 88 for this purpose.

Figure 4:
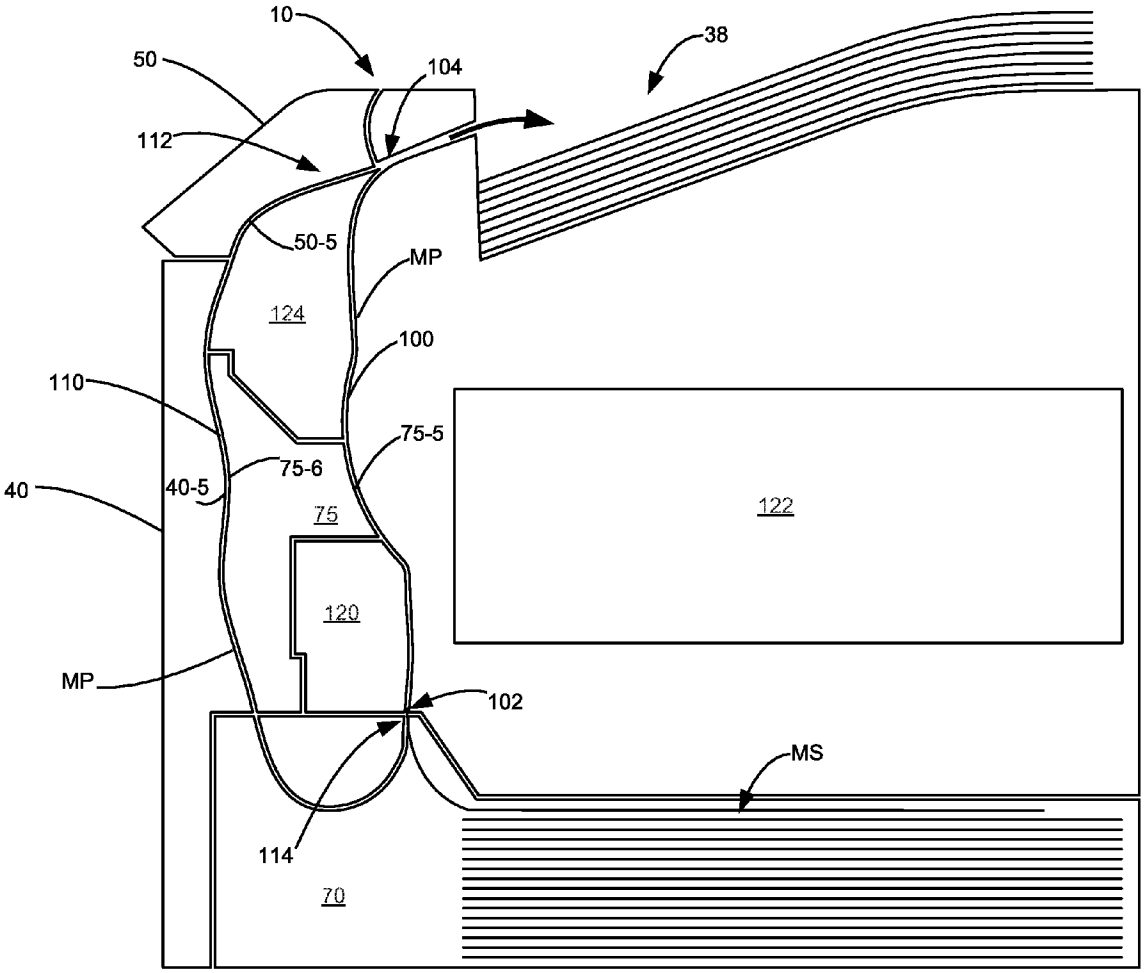
FIGS. 4-5 are schematic illustrations of the major components of the imaging device depicted in FIGS. 1-2 where
Figure 5:
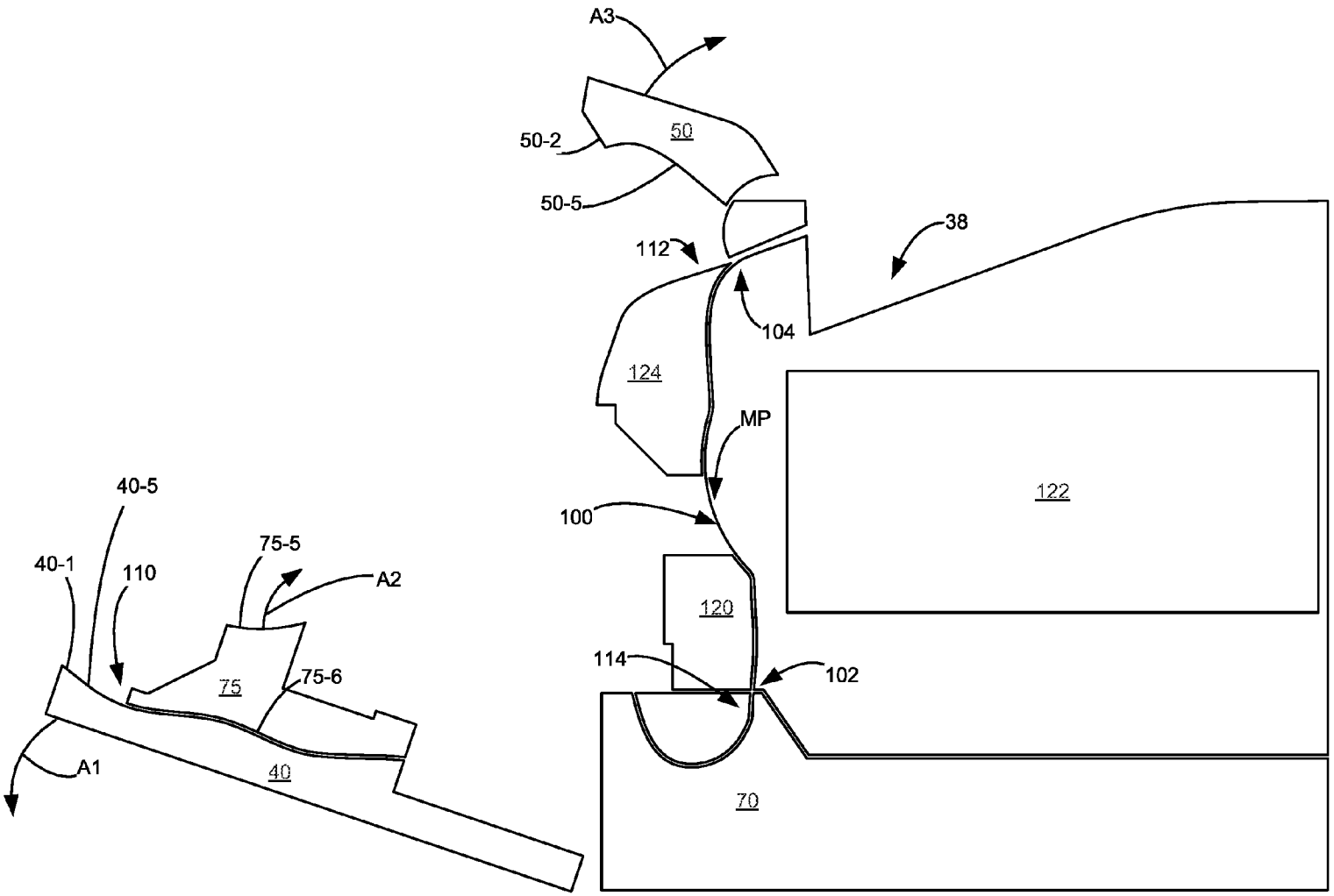

Referring to FIGS. 4-5, the media path MP through imaging device 10 can be seen. A simplex portion 100 of media path MP extends from an entrance 102 located adjacent to removable media tray 70 to an exit 104 located adjacent media output area 38. Media tray 70 holds a media stack MS of media sheets to be imaged. The simplex portion 100 runs past a bump alignment area 120, an imaging area 122, and a fuser 124. After the leading edge of a media sheet is aligned perpendicular to the media path MP in the bump alignment area 120, a toned image is created and transferred to a media sheet as it passes through imaging area 122 and, at fuser 124, the toned image is fused to the media sheet. Imaging area 122 contains components such as photoconductive drums, toner transfer rolls toner cartridges, intermediate transfer units as in known in the art.

The media sheet is then directed to exit 104 where it can be fed into media output area 38 or be fed into the duplex portion 110 of media path MP. An entrance 112 of the duplex portion 110 is adjacent to exit 104 of simplex portion 100 and an exit 114 of duplex portion 110 merges with the entrance 102 of the simplex portion 100. As shown the simplex and duplex portions 100, 110 are generally C-shaped. An inner surface 40-5 of front access door 40 and an inner surface 50-5 of top access door 50 form a portion of the duplex portion 110 of media path MP. Also, pivotally mounted on front access door 40 is an interior door 75 having inner and outer surfaces 75-5, 75-6 that form part of simplex portion 100 and duplex portion 110, respectively, of media path MP.

As shown in FIG. 5 when front access door 40 is opened and rotated downward as indicated by arrow A1, a part of simplex portion 100 of media path MP is exposed along with interior door 75. Interior door 75 is now accessible and may be pivoted open as indicated by the curved arrow A2 exposing duplex portion 110 of media path MP. Next, top access door 50 may be opened and rotated up to its open position as indicated by arrow A3. Opening top access door 50 exposes the exit 104 and entrance 112 of the simplex and duplex portions 100, 110, respectively, of media path MP. As explained hereinafter, one or both of front and top access doors 40, 50 have media guide ribs that may cantilever out from top edge 40-1 and bottom edge 50-2 of front and top access doors 40, 50, respectively, requiring that the two doors be closed in the correct sequence to return media path MP to its correct configuration.

Figure 6:
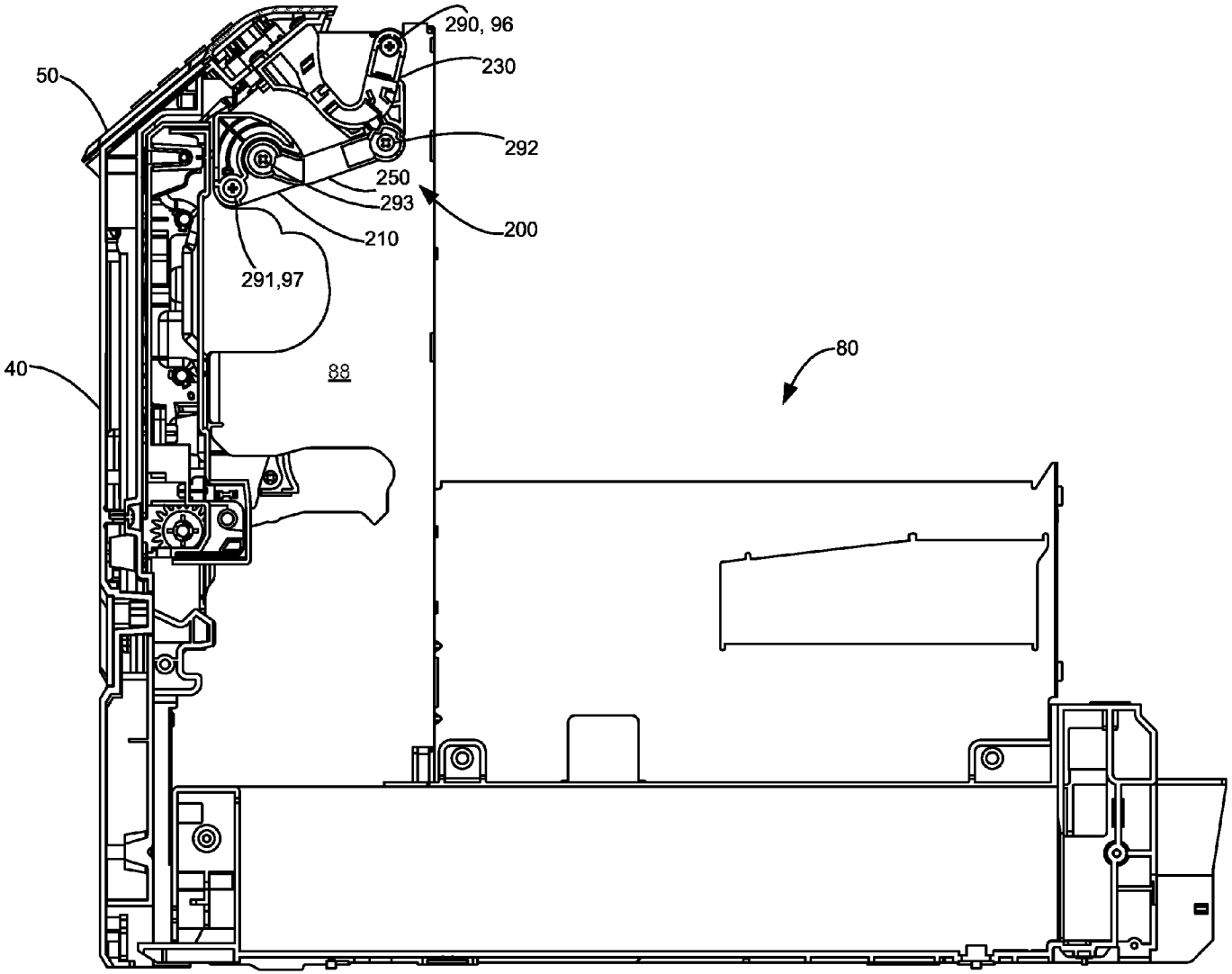
FIG. 6 is an elevational view of the right side of the frame of the imaging device showing the front and top access door doors in the closed position with the front access door having its covers removed with the sequencing device of the present disclosure shown in its retracted position.

FIG. 6 illustrates door sequencing device 200 mounted on the right side panel 88 of frame 80 using fasteners 290, 291, such as screws 290, 291, mounted to mounting openings 96, 97, respectively. Briefly, sequencing device 200 comprises a door stop 210 and a hinge 230 interconnected by a link 250. Door stop 210 and a first end of hinge 230 are pivotally fastened by fasteners 291, 290, respectively, to the right side panel 88. A second end of hinge 230 is attached the inner surface 50-5 of top access door 50 near right edge 50-4. Fasteners 294, 295, extending through first and second mounting openings 53, 54, respectively, provided in top access door 50, secure the second end 230-2 of hinge 230 to top access door 50 (see FIG. 14). Link 250 is pivotally connected to door stop 210 and hinge 230 by fasteners 293, 292, respectively. Front access door 40 and top access door 50 are shown in their respective closed positions and sequencing device 200 is in its retracted position.

In FIG. 7, front access door 40 has been lowered into its open position. Interior door 75 has also been opened exposing a part of the duplex portion 110 of media path MP. A plurality of parallel media guide ribs 48 are provided in the inner surface 40-5 of front access door 40. Ribs 48 extend from a position adjacent to top edge 40-1 of front access door 40 to a position adjacent to the bottom edge 40-2 of front access door 40. Top access door 50 is in its closed position and sequencing device 200 is in its retracted position on right side panel 88. Hinge arm 56 of top access door 50 can be seen connected to pivot mount 92 on left side panel 86 of frame 80.

In FIG. 8, top access door 50 has been rotated and raised into its open position by a user lifting the top access door 50 by its bottom edge 50-2. Front access door 40 remains in its open position. A plurality of media guide ribs 58 can be seen on the inner surface 50-5 of top access door 50. The ends of the plurality of guide ribs 58 adjacent bottom edge 50-2 of top access door 50 extend in a cantilever fashion and interleave with the plurality of guide ribs 48 found on the inner surface 40-5 of the front access door 40 when the two doors are in their respective closed positions. The action of hinge 230 and link 250 causes door stop 210 to rotate out in front of right side panel 88. Opening of top access door 250 cause hinge 230 to rotate clockwise as viewed pushing link 250 forward which in turn rotates door stop 210 counter clockwise and forward. When door stop 210 is in this extended position it will prevent front access door 40 from closing.

Figure 9:
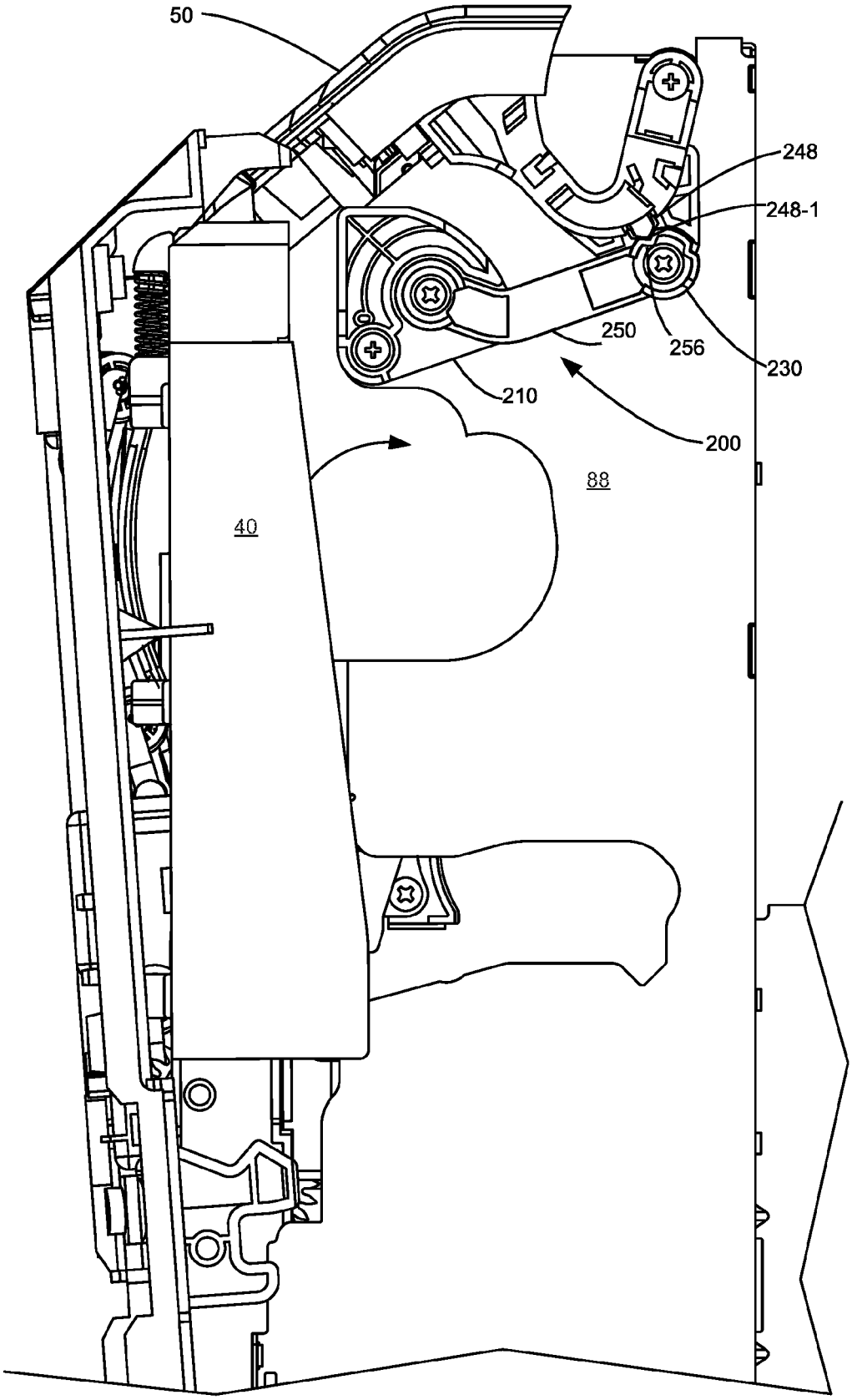
FIG. 9 illustrates a proper closing sequence of the two access doors showing the front access door approaching its closed position with the top access door in its closed position and the sequencing device in its retracted position.

In FIG. 9, top access door 50 has been rotated and lowered into its closed position by a user pushing down on the top access door 50. Door stop 210 has been rotated back into its retracted position by the actions of hinge 230 and link 250. Closing of top access door 50 causes hinge 230 to reverse its rotation and move counterclockwise as viewed to draw link 250 back, which in turn rotates door stop 210 clockwise and back into its retracted position allowing front access door 40 to close completely.

Figure 10:
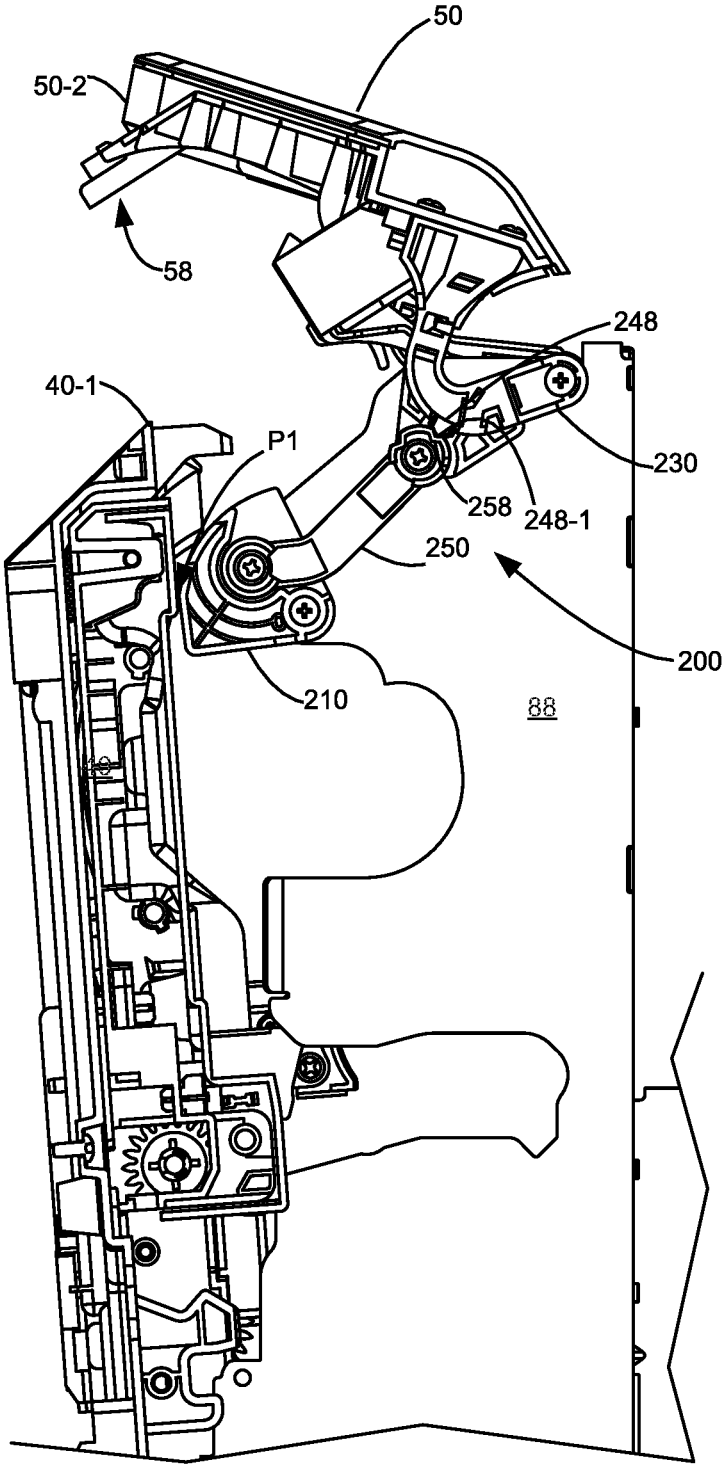
FIG. 10 illustrates an improper closing sequence of the two access doors showing the front access door approaching its closed position with the top access door open and the front access door encountering the extended sequencing device preventing it from closing.
Figure 11:
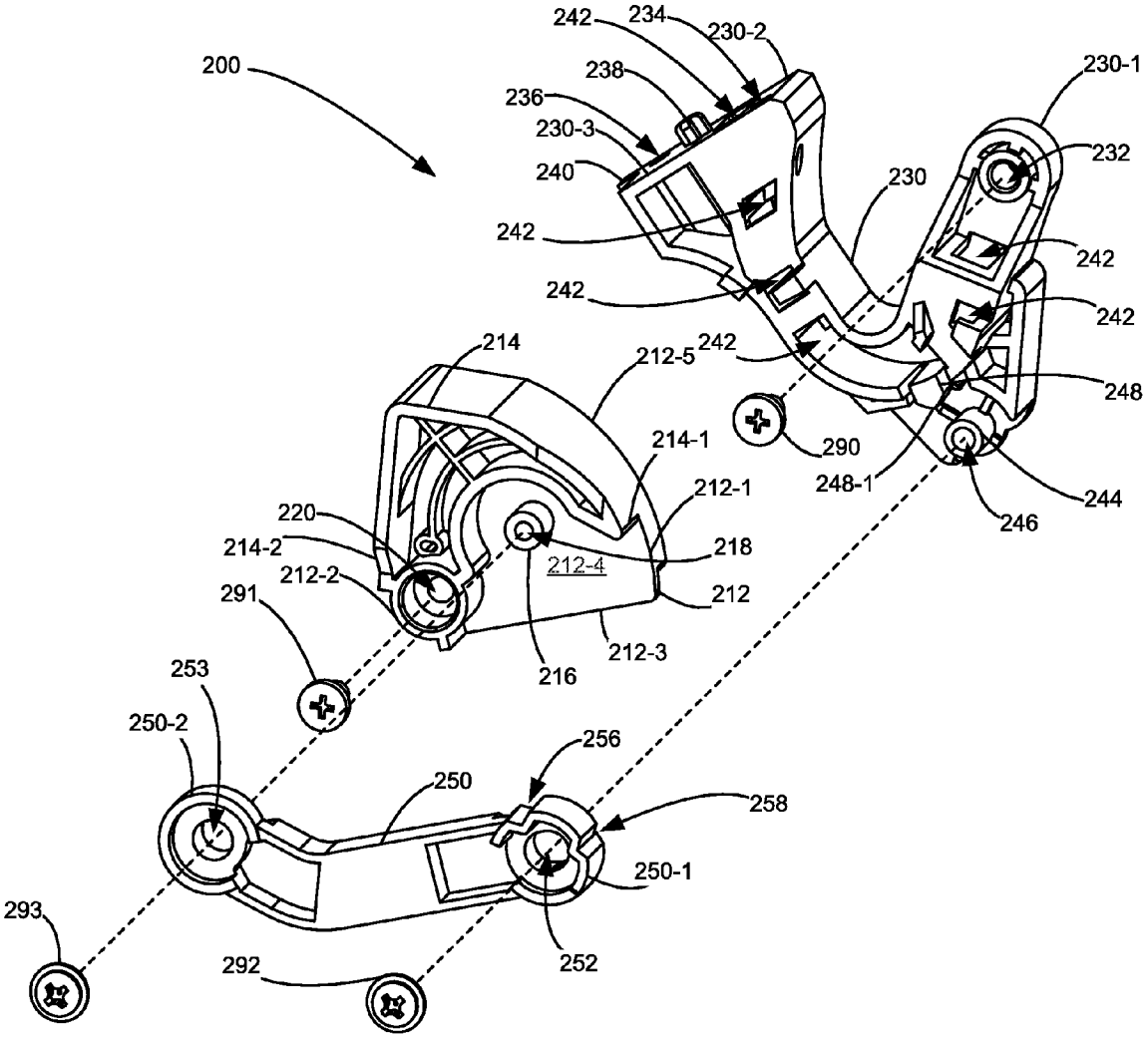
FIG. 11 is an exploded view of the sequencing device of the present disclosure.

In FIG. 10, top access door 50 is in its open position and door stop 210 remains in its extended position. Front access door 40 has been moved toward its closed position. However, front access door 40 encounters down stop 210 preventing it from closing. To close top access door 50, a user would lower front access door 40 slightly away from door stop 210, as indicated by arrow A4, a distance sufficient to allow the plurality of cantilevered media guide ribs 58 and the bottom edge 50-2 of top access door 50 to clear the top edge 40-1 of front access door 40.

Referring to FIGS. 11-15, the features of sequencing device 200 will be described. Sequencing device 200 comprises door stop 210, hinge 230 and link 250. Door stop 210 includes a generally triangular planar base 212 having a first, a second and a third side 212-1, 212-2, 212-3, an outer surface 212-4 and an inner surface 212-5. Inner surface 212-5 faces right side panel 88. A wall 214 depends from an outer surface 212-4 of base 212 and substantially extends around two sides of the base 212, sides 212-1, 212-2 as shown. A first end 214-1 of wall 214 is located spaced apart from the corner formed between the first and third sides 212-1, 212-3 while the second end 214-2 of wall 214 is located substantially at the corner formed between the second and third sides 212-2, 212-3. Wall 214 forms an abutment surface against which the inner surface 40-5 of the front access door 40 rests when the door stop 210 is in its extended position Mounting boss 216, having a first opening 218 therein, is provided on outer surface 212-4 of base 212 (as viewed with respect to right side panel 88). Mounting boss 216 is positioned approximately in the center of base 212. A second opening 220 is provided through base 212 adjacent to a corner formed between two of its sides, second and third sides 212-2, 212-3 of base 212 as shown. Fastener 291 passes through opening 220 and is received in mounting opening 97 in right side panel 88. Door stop 210 pivots about fastener 291 and the corner formed between second and third sides 212-2, 212-3 of base 212.

Hinge 230 is generally a C-shaped body having an opening 232 at a first end 230-1 thereof. Fastener 290 is received into opening 232 and in mounting opening 96 on right side panel 88. Hinge 230 pivots about fastener 290 as the top access door 50 is opened and closed. A second end 230-2 of hinge 230 is a generally planar rectangle. Mounting openings 234, 236 and a first alignment member 238 are provided in the outer surface 230-3 of second end 230-2. A second alignment member 240 depends from the second end 230-2. First alignment member 238 has a cruciform shape and second alignment member 240 has a rectangular block shape. A wireway 242 is provided between first and second ends 230-1, 230-2 of hinge 230 for wiring between user interface 60 and a controller (not shown) provided in imaging device 10. A mounting boss 244 having opening 246 is provided on hinge 230 approximately midway between the first and second ends 230-1, 230,2. A detent finger 248 depends from hinge 230 at a position adjacent to mounting boss 244. A distal end 248-1 of detent finger 248 has a V-shaped profile.

Figure 13:
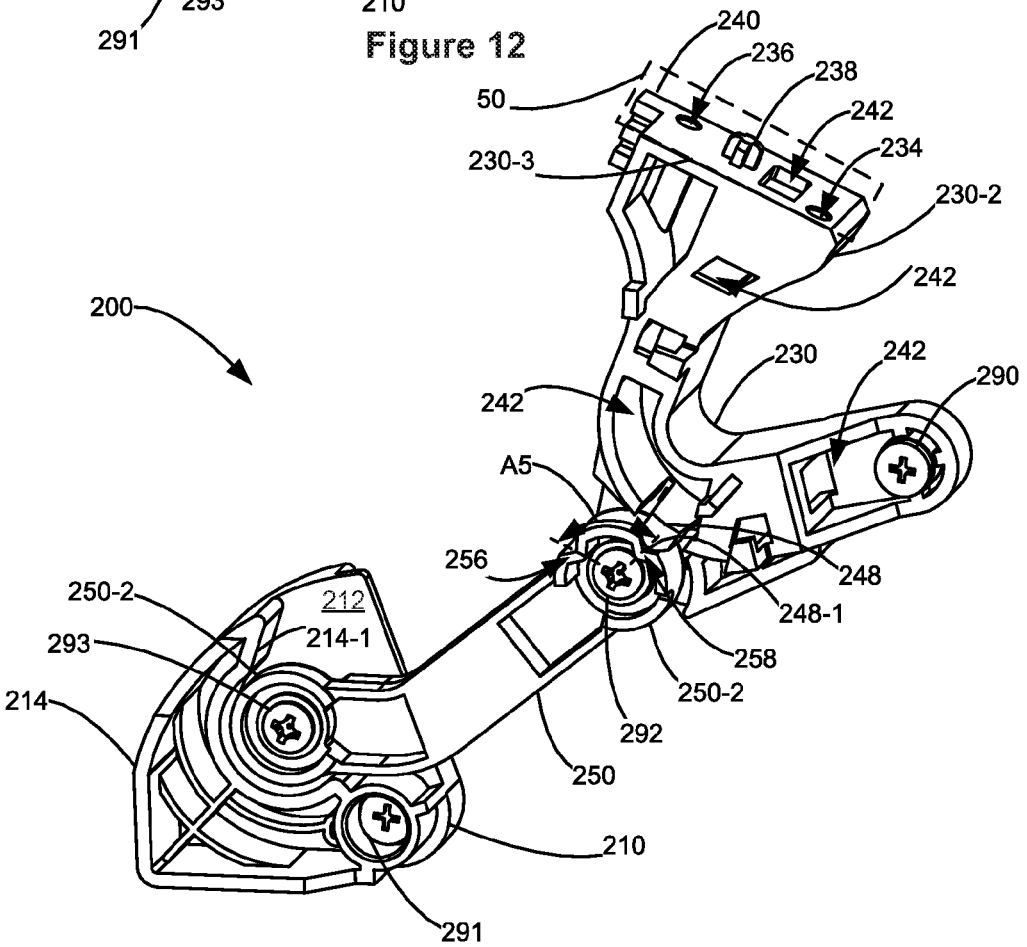

Link 250 is generally rectangular in shape and has first and second mounting openings 252, 253 centered at its first and second ends 250-1, 250-2, respectively. Both first and ends 250-1, 250-2 are rounded. First opening 252 receives mounting boss 246 of hinge 230 and second opening 253 receives mounting boss 216 of door stop 210. Fastener 292 passes through opening 252 and is received in mounting opening 246 in mounting boss 244 while fastener 293 passes through opening 253 and is received in opening 218 of mounting boss 216. Link 250 is rotatably connected to both door stop 210 and hinge 230. First and second detents 256, 258 are provided on the outer periphery of first end 250-1. As shown in FIG. 13, first and second detents 256, 258, are spaced approximately 90 degrees apart as indicated by arrow A5. This spacing is a matter of design choice and not of limitation.

Figure 12:
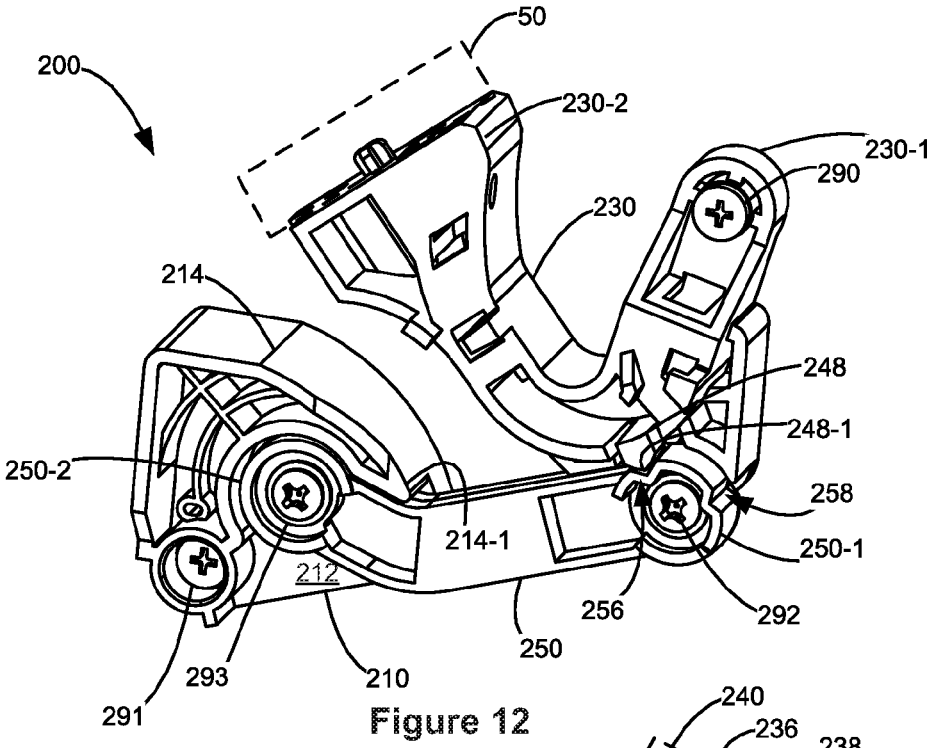
FIGS. 12-13 illustrate the sequencing device of the present disclosure where

As shown in FIGS. 9 and 12, when top access door 50 is in the closed position, the distal end 248-1 of detent finger 248 is engaged in first detent 256. As top access door 50 is raised, detent finger 248 releases from first detent 256. As top access door 50 continues opening, the distal end 248-1 of detent finger 248 engages with second detent 258 providing tactile feedback to the user that the door has reached its open position as shown in FIGS. 10 and 13. Detent finger 248 ensures that top access door 50 remains in the open position. The process is reversed upon closing of top access door 50 with first detent 256 providing tactile feedback to the user that top access door 50 has reached its closed position.

Figure 14:
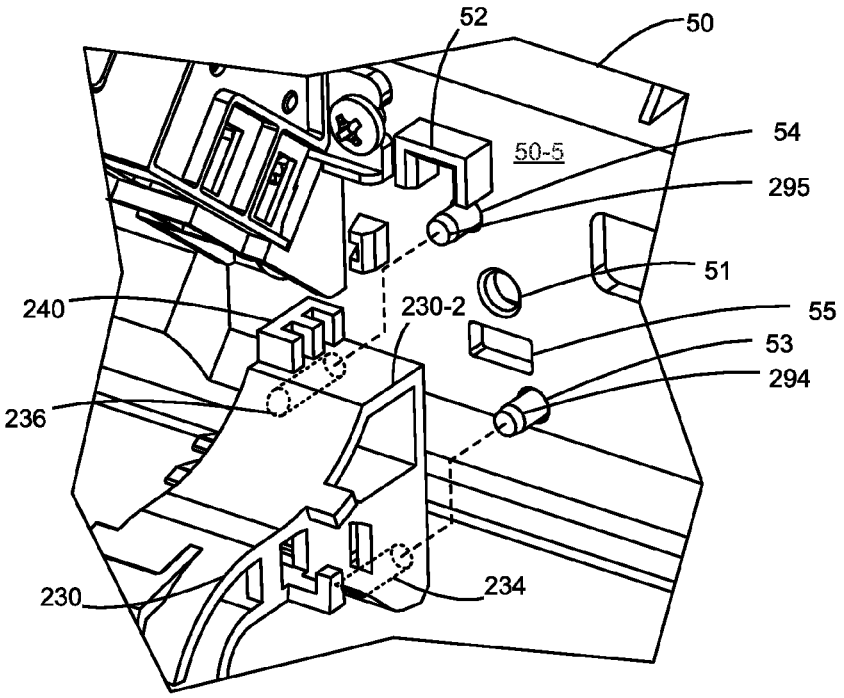
FIGS. 14-15 illustrate the attachment of the sequencing device of the present disclosure to the top access door.
Figure 15:
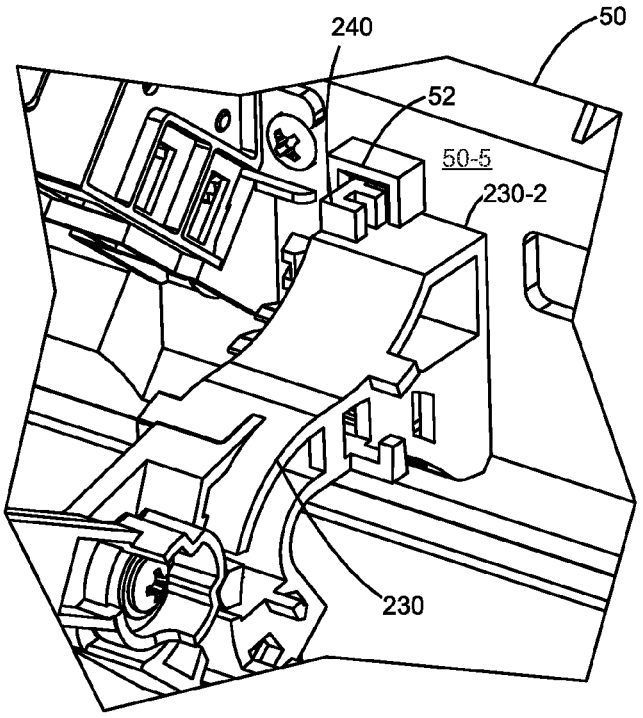

Referring to FIGS. 13-15 the attachment of hinge 230 to top access door 50 is illustrated. Second end 230-2 of hinge 230 is attached to the inner surface 50-5 of top access door 50. Fasteners 53, 54 are received into mounting openings 234, 236, respectively. An alignment opening 51 receives first alignment member 238 which due to its cruciform shape is self-centering. Second alignment member 240 is received into a 3-sided alignment bracket 52 positioned on the inner surface 50-5 of top access door 50. An opening 55 in top access door 50 aligns with the end wireway 242 in second end 230-2 of hinge 230.

Figure 16:
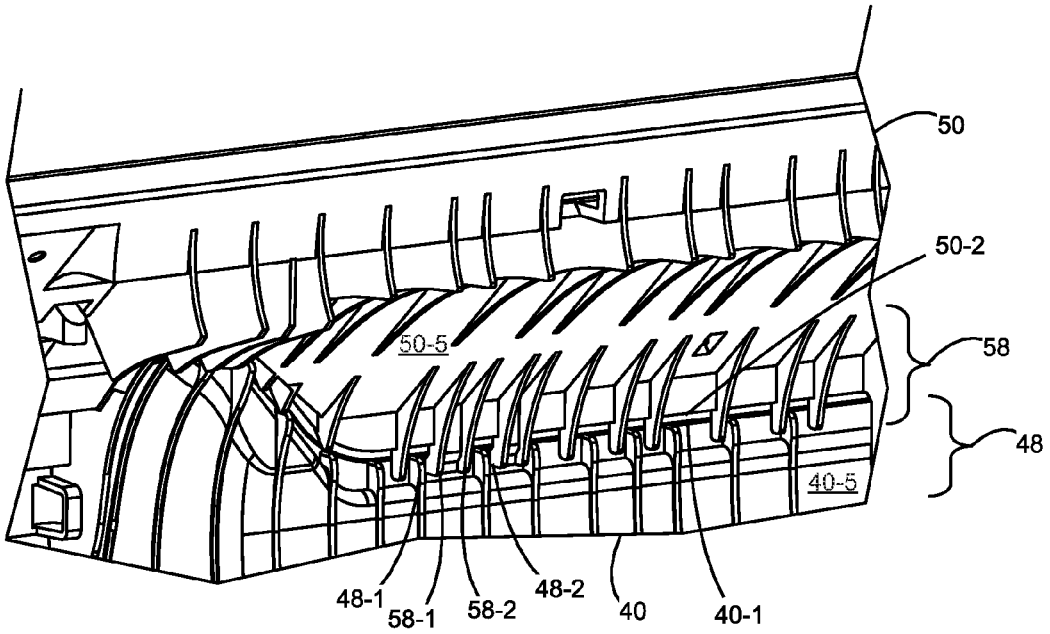
FIG. 16 illustrates the top access door having cantilevered guide ribs that interleave with guide ribs on the front access door.
Figure 17:
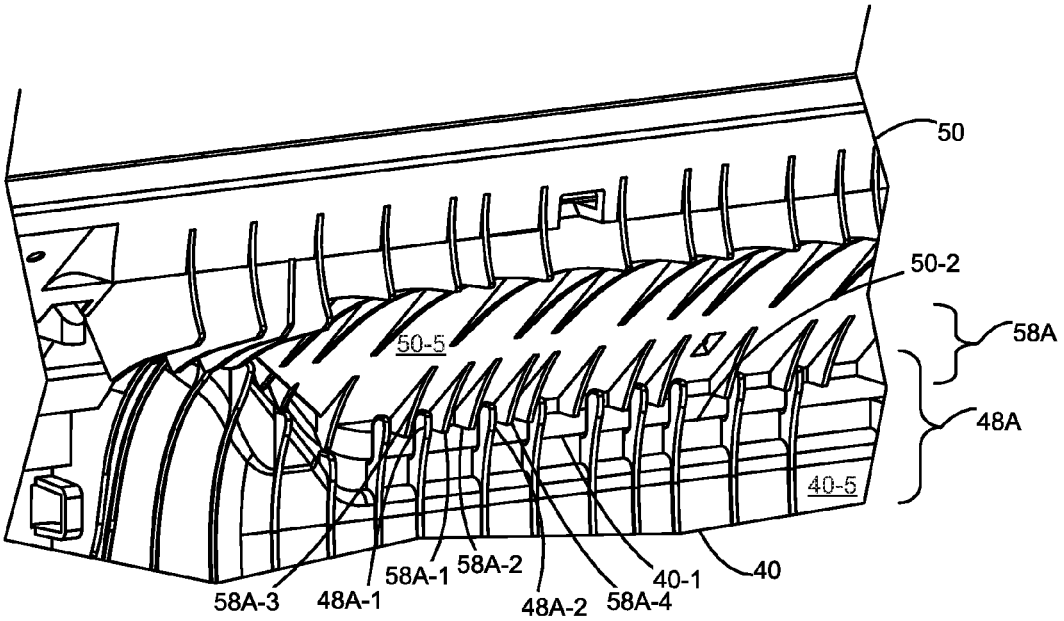
FIG. 17 illustrates the front access door having cantilevered guide ribs that interleave with guide ribs on the top access door.
Figure 18:
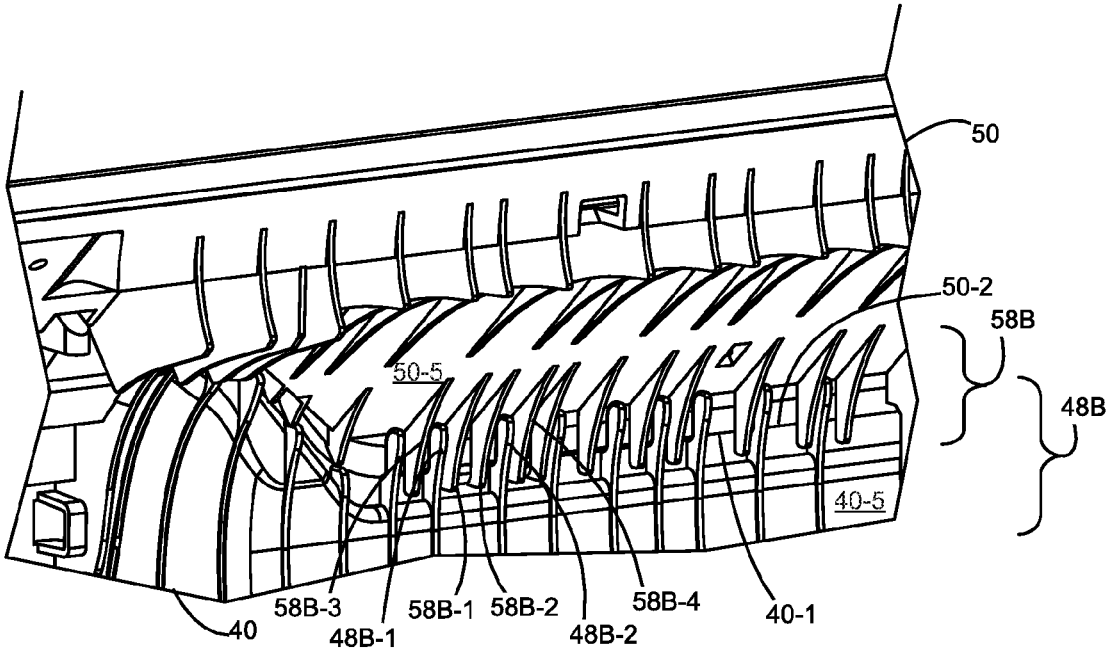
FIG. 18 illustrates the top access door and the front access door each having cantilevered guide ribs that interleave with the guide ribs on the opposite access door.

FIGS. 16-18 illustrate various interleaving configurations of the media guide ribs 48, 58, found on the inner surfaces 40-5, 50-5 of front and top access doors 40, 50, respectively. FIG. 16 illustrates media guide ribs 58 having their distal ends cantilevered beyond bottom edge 50-2 of top access door 50 and interleaving with media guide ribs 48 on front access door 40. For example, media guide ribs 58-1, 58-2 extend beyond bottom edge 50-2 of top access door 50 and interleave between media guide ribs 48-1, 48-2 on front access door 40. FIG. 17 illustrates media guide ribs 48A having their distal ends cantilevered beyond top edge 40-1 of front access door 40 and interleaving with media guide ribs 58A on top access door 50. For example, media guide ribs 48A-1, 48A-2 extend beyond top edge 40-1 of front access door 40 and interleave between media guide ribs 58A-1, 58A-2 on top access door 50. FIG. 18 illustrates both front and top access doors 40, 50 having cantilevered media guide ribs. Media guide ribs 58B have their distal ends cantilevered beyond bottom edge 50-2 of top access door 50 and interleave with media guide ribs 48B on front access door 40. Media guide ribs 48B have their distal ends cantilevered beyond top edge 40-1 of front access door 40 and interleave with media guide ribs 58B on top access door 50. For example, media guide ribs 58B-1, 58B-2 extend beyond bottom edge 50-2 of top access door 50 and interleave between media guide ribs 48B-1, 48B-2 on front access door 40 that extend beyond top edge 40-1 of front access door 40. Media guide ribs 48B-1, 48B-2 interleave between media guide ribs 58B-1, 58B-3 and media guide ribs 58B-2, 58B-4, respectively on top access door 50.

The foregoing description of several methods and an embodiment of the present disclosure have been presented for purposes of illustration. It is not intended to be exhaustive or to limit the present disclosure to the precise steps and/or forms disclosed, and obviously many modifications and variations are possible in light of the above description. It is intended that the scope of the present disclosure be defined by the claims appended hereto.

What is claimed is:

1. An imaging device comprising:

a frame having a pair of opposed panels spaced apart and having a media path therebetween;

a first access door pivotally mounted along a bottom edge thereof to the frame, the first access door having a raised closed position and a lowered open position with respect to the frame, the first access door substantially covering a first portion of the media path between the pair of opposed panels when in the closed position, the first access door having a mating edge and an inner surface having a first plurality of media guide ribs;

a second access door pivotally mounted between the pair of opposed panels, the second access door having a raised open position and a lowered closed position with respect to the frame, the second access door substantially covering a second portion of the media path between the pair of opposed panels when in the closed position, the second access door having a mating edge aligned with the mating edge of the first access door when the first and second access doors are in their respective closed positions and an inner surface having a second plurality of media guide ribs, at least one of the first and second pluralities of media guide ribs having a cantilevered section extending beyond the respective mating edge; and, a door sequencing device attached between the frame and the second access door, the door sequencing device including:

a door stop connected to one of the opposed panels and pivotable between a retracted position and an extended position;

a hinge pivotally connected at a first end to the one of the opposed panels and attached at a second end to the second access door, the hinge having a detent finger extending therefrom; and, a link having a first end pivotally connected to the door stop and a second end pivotally connected to the hinge adjacent to the detent finger, the second end of the link having a first detent and a second detent sized to receive an end of the detent finger with the second detent spaced apart from the first detent, wherein, when the second access door is in the closed position and the first access door is in the open position, the detent finger is in first detent and the door stop is in the retracted position allowing the first access door to be moved into a closed position, and, when the second access door and the first access door are in their respective open positions, the detent finger is in the second detent holding the second access door in its open position, the door stop has rotated out into its extended position preventing the first access door from reaching its closed position until the second access door is moved into its closed position rotating the door stop back into its retracted position with the detent finger returning to the first detent.

2. The imaging device of claim 1, wherein, the second access door has a user interface panel mounted on an outer surface thereof.

3. The imaging device of claim 1, wherein, the second access door has a positioning opening on an inner surface and the second end of the hinge has a positioning pin sized to be received in the positioning opening.

4. The imaging device of claim 1, wherein, the hinge has an alignment member depending from the second end thereof and the second access door has an alignment bracket on the inner surface thereof sized for receiving the alignment member when the second end of the hinge is attached to the second access door.

5. The imaging device of claim 1, wherein, the hinge has a wireway extending between the first and second ends of the hinge.

6. The imaging device of claim 1, wherein, the door stop comprises a base having a wall depending therefrom, the wall forming an abutment surface that comes into contact with the inner surface of the first access door preventing the first access door from closing when the second access door is in the open position.

7. An imaging device comprising:

a frame having a pair of opposed panels spaced apart and having a media path therebetween;

a first access door pivotally mounted along a bottom edge thereof to the frame, the first access door having a raised closed position and a lowered open position with respect to the frame, the first access door substantially covering a first portion of the media path between the pair of opposed panels when in the closed position, the first access door having a mating edge and an inner surface having a first plurality of media guide ribs;

a second access door pivotally between the pair of opposed panels, the second access door having a raised open position and a lowered closed position, the second access door substantially covering a second portion of the media path between the pair of opposed panels when in the closed position, the second access door having a mating edge aligned with the mating edge of the first access door when the first and second access doors are in their respective closed positions and an inner surface having a second plurality of media guide ribs, at least one of the first and second pluralities of media guide ribs having a cantilevered section extending beyond the respective mating edges; and, a door sequencing device attached between the frame and the second access door, the door sequencing device including:

a door stop connected to one of the opposed panels and pivotable between a retracted position and an extended position, the door stop having a base having wall about a portion of its periphery, the wall having a substantially right angle corner;

a C-shaped hinge pivotally connected at a first end to the one of the opposed panels and attached at a second end to the second access door, the hinge having a detent finger extending outwardly therefrom at a position approximately midway between the first and second ends; and, a link having a first end pivotally connected to the door stop and a second end pivotally connected to the hinge adjacent to the detent finger, the second end of the link having a first detent and a second detent sized to receive an end of the detent finger with the second detent spaced apart from the first detent, wherein, when the second access door is in the closed position and the first access door is in the open position, the detent finger is in first detent and the door stop is in the retracted positioned allowing the first access door to be moved into its closed position, and, when the first and second access doors are in their respective open positions, the detent finger is in the second detent holding the second access door in its open position and the door stop has rotated out into its extended position with the wall forming an abutment surface that contacts the first access door, preventing the first access door from reaching its closed position until the second access door is moved into its closed position and the door stop has rotated back into its retracted position.

8. The imaging device of claim 7, wherein, the second access door has a user interface panel mounted on an outer surface thereof.

9. The imaging device of claim 7, wherein, the second access door has a positioning opening on the inner surface and the second end of the hinge has a positioning pin sized to be received in the positioning opening.

10. The imaging device of claim 7, wherein, the hinge has an alignment member depending from the second end thereof and the second access door has an alignment bracket on the inner surface thereof sized for receiving the alignment member when the second end of the hinge is attached to the second access door.

11. The imaging device of claim 7, wherein, the hinge has a wireway extending between the first and second ends of the hinge.

12. The imaging device of claim 7, wherein, the base of door stop is substantially triangular with the wall extending about a first side and an adjacent second side thereof, the base having a mounting opening positioned at an apex formed by one of the first side and the second side with the third side of the base for receiving a fastener for pivotally mounting the door stop.

13. An imaging device comprising:

a frame having a pair of opposed panels spaced apart and having a media path therebetween;

a bottom access door pivotally mounted along a bottom edge thereof to the frame, the bottom access door having a raised closed position and a lowered open position with respect to the frame, the bottom access door substantially covering a first portion of the media path between the pair of opposed panels when in the closed position, the bottom access door having a top mating edge and an inner surface having a first plurality of media guide ribs, the first plurality of media guide ribs having a cantilevered portion extending beyond the top mating edge;

a top access door pivotally mounted between the pair of opposed panels, the top access door having a raised open position and a lowered closed position, the top access door substantially covering a second portion of the media path between the pair of opposed panels when in the closed position, the top access door having a bottom mating edge aligned with the top mating edge of the first access door when the first and second access doors are in their respective closed positions and an inner surface having a second plurality of media guide ribs; and, a door sequencing device attached between the frame and the top access door, the door sequencing device including:

a door stop connected to one of the opposed panels and pivotable between a retracted position and an extended position, the door stop having a generally triangular base having a first, a second, and a third side and having a wall extending about a portion of the first and second sides, the wall having respective ends positioned away from the third side, the base having a first and a second mounting opening, the first mounting opening adjacent one end of the wall and the third side and the second mounting opening positioned approximately in the center of the base, the base fastened to the one of the opposed panels via the first mounting opening;

a C-shaped hinge pivotally connected at a first end to the one of the opposed panels and attached at a second end to the top access door, the hinge having a detent finger extending outwardly therefrom at a position approximately midway between the first and second ends thereof, the hinge having a first and a second mounting opening, the first mounting opening positioned adjacent to the first end for pivotally connecting the hinge to the one of the opposed panels, the second mounting opening positioned adjacent to the detent finger; and, a link having a first rounded end pivotally connected to the door stop at the second mounting opening of the door stop and a second rounded end pivotally connected to the second mounting opening of the hinge, the second end of the link having a first detent and a second detent sized to receive an end of the detent finger with the second detent spaced apart from the first detent by approximately 90 degrees, wherein, when the top access door is in the closed position and the bottom access door is in the open position, the detent finger is in the first detent and the door stop is in its retracted positioned allowing the bottom access door to be moved into its closed position, and, when the top and bottom access doors are in their respective open positions with the detent finger being in the second detent holding the top access door in its open position, the door stop has rotated approximately 90 degrees out into its extended position with a portion of the wall forming an abutment surface preventing the bottom access door from reaching its closed position until the top access door is moved into its closed position.

14. The imaging device of claim 13, wherein, the top access door has a user interface panel mounted on an outer surface thereof.

15. The imaging device of claim 13, wherein, the top access door has a positioning opening on the inner surface and the second end of the hinge has a positioning pin sized to be received in the positioning opening.

16. The imaging device of claim 13, wherein, the top access door has an alignment bracket on the inner surface for receiving a corner of the second end of the hinge when the second end is attached to the top access door.

17. The imaging device of claim 13, wherein, the hinge has a wireway extending between the first and second ends of the hinge.

18. The imaging device of claim 13, wherein, the hinge has an alignment member depending from the second end thereof and the top access door has an alignment bracket on an inner surface sized for receiving the alignment member when the second end of the hinge is attached to the top access door.

* * * * *